US007724200B2

(12) United States Patent
Kitamori et al.

(10) Patent No.: US 7,724,200 B2
(45) Date of Patent: May 25, 2010

(54) ANTENNA DEVICE, ARRAY ANTENNA, MULTI-SECTOR ANTENNA, HIGH-FREQUENCY WAVE TRANSCEIVER

(75) Inventors: Nobumasa Kitamori, Kyoto-fu (JP); Tomohiro Nagai, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 121 days.

(21) Appl. No.: 12/177,935

(22) Filed: Jul. 23, 2008

(65) Prior Publication Data

US 2008/0272976 A1 Nov. 6, 2008

Related U.S. Application Data

(63) Continuation of application No. PCT/JP2007/052958, filed on Feb. 19, 2007.

(30) Foreign Application Priority Data

Feb. 23, 2006 (JP) ..... 2006-046749

(51) Int. Cl.
*H01Q 1/38* (2006.01)
*H01Q 9/28* (2006.01)
*H01Q 21/08* (2006.01)

(52) U.S. Cl. ..... 343/795; 343/818; 343/833

(58) Field of Classification Search ..... 343/700 MS, 343/702, 793, 795, 810, 812–821, 833, 834, 343/846

See application file for complete search history.

(56) References Cited

U.S. PATENT DOCUMENTS 5,021,799 A 6/1991 Kobus et al.

(Continued)

FOREIGN PATENT DOCUMENTS

JP 2000-216615 4/2000

(Continued)

OTHER PUBLICATIONS

Deal et al., W.R., "A New Quasi-Yagi Antenna for Planar Active Arrays," IEEE Transactions on Microwave Theory and Techniques, vol. 48, Issue 6, (Jun. 2000), pp. 910-918.*

(Continued)

*Primary Examiner*—Michael C Wimer
(74) *Attorney, Agent, or Firm*—Dickstein, Shapiro, LLP

(57) ABSTRACT

An antenna device having a feeder electrode that extends linearly on a top surface of a dielectric substrate. A balanced electrode having two balanced transmission electrodes vertical to the extending direction of the feeder electrode and extending in parallel. The two balanced transmission electrodes are connected to the feeder electrode and separated by an interval of ½ of a wavelength of a transmission/reception signal. A radiation electrode having a first electrode connected to the one of the two balanced transmission electrodes and a second electrode connected to the other of the two balanced transmission electrodes and is positioned parallel to the feeder electrode. A waveguide electrode is formed at a position separated from the radiation electrode by a predetermined interval and in parallel to the radiation electrode. A ground electrode is formed at an area of a back surface of the dielectric substrate corresponding to an area including a portion where the feeder electrode is positioned. By connecting the two balanced electrodes to the feeder electrode at an interval of ½ of a wavelength in this manner, this branch portion has a signal branching function and a balun function at the same time.

19 Claims, 9 Drawing Sheets

U.S. PATENT DOCUMENTS

| | | | | |
|---|---|---|---|---|
| 6,046,704 | A * | 4/2000 | Lopez | 343/821 |
| 6,147,653 | A | 11/2000 | Wallace et al. | |
| 6,163,306 | A | 12/2000 | Nakamura et al. | |
| 6,529,171 | B1 * | 3/2003 | Le Balier et al. | 343/795 |
| 6,839,038 | B2 * | 1/2005 | Weinstein | 343/795 |
| 7,218,287 | B2 * | 5/2007 | Hung et al. | 343/795 |

FOREIGN PATENT DOCUMENTS

| | | |
|---|---|---|
| JP | 2001-274605 | 5/2001 |
| JP | 2003-8312 | 10/2003 |
| JP | 2004-159185 | 6/2004 |
| JP | 2005-333392 | 2/2005 |
| JP | 3734666 | 10/2005 |

OTHER PUBLICATIONS

Kaneda et al., N., "A Broadband Planar Quasi-Yagi Antenna," IEEE Transactions on Antennas and Propagation, vol. 50, Issue 8, (Aug. 2002), pp. 1158-1160.*

PCT/JP2007/052958 International Search Report dated Mar. 13, 2007.

PCT/JP2007/052958 Written Opinion dated Mar. 13, 2007.

Deal, W.R., A New Quasi-Yagi Antenna, Antennas and Propagation, IEEE Transactions on vol. 50, Issue 8, 2002, pp. 1158-1160.

Kaneda, N., A Broadband Planar Quasi-Yagi Antenna, Antennas and Propagation, IEEE Transactions on vol. 50, Issue 5, 2002 pp. 1158-1160.

Neculoiu, D. Yagi-Uda Antenna Fabricated on Thin Gas Membrane for Millimeter Wave Applications, IWAT 2005, IEEE International Workshop on Mar. 7-9, 2005; pp. 418-421.

* cited by examiner (A)

ANTENNA DIRECTIVITY CHARACTERISTIC (B)

ANTENNA DEVICE, ARRAY ANTENNA, MULTI-SECTOR ANTENNA, HIGH-FREQUENCY WAVE TRANSCEIVER

CROSS REFERENCE TO RELATED APPLICATIONS

The present application is a continuation of International Application No. PCT/JP2007/052958, filed Feb. 19, 2007, which claims priority to Japanese Patent Application No. JP2006-046749, filed Feb. 23, 2006, the entire contents of each of these applications being incorporated herein by reference in their entirety.

FIELD OF THE INVENTION

The present invention relates to antenna devices based on dipole antennas and, in particular, to a planar antenna device having dipole electrodes formed on a dielectric substrate. Furthermore, the present invention relates to an array antenna in which a plurality of these antenna devices are arranged, a multi-sector antenna having a plurality of array antennas, and a high-frequency wave transceiver.

BACKGROUND OF THE INVENTION

In the related art, Yagi-Uda antennas are one of antenna devices well known to the public. Such Yagi-Uda antennas include a planar type that employs a dielectric substrate in order to be included in a vehicle-mounted radar apparatus or the like to save space. Non-Patent Document 1 discloses an antenna device including an array of such planar Yagi-Uda antennas.

FIGS. 12(A) and (B) are configuration diagrams of an antenna disclosed in Non-Patent Document 1, whereas (C) is a configuration diagram of an array antenna in which a plurality of antenna devices of (A) and (B) are arranged. Meanwhile, illustration of a ground electrode provided on a back surface is omitted in (C).

As shown in FIG. 12, in an antenna device 100 of Non-Patent Document 1, a feeder portion electrode 20, an unbalanced-balanced transformer electrode (hereinafter, referred to as a balun electrode) 30, a radiation portion electrode 40, and a waveguide portion electrode 50 are formed on a top surface 111 of a dielectric substrate 101, whereas a ground electrode 60 is formed on a back surface 112 thereof.

The feeder portion electrode 20 is formed like a line extending in a predetermined direction. One end thereof is connected to the balun electrode 30. The balun electrode 30 has two U-shaped electrodes arranged so that openings thereof face each other and is formed in a shape spreading in a direction vertical to the extending direction of the feeder portion electrode 20. One of the two U-shaped electrodes (the U-shaped electrode on the right when FIG. 12 is viewed from the front) is formed in a shape of which the electrical length thereof is longer than that of the other one by a half wavelength ($\lambda/2$) of a transmission/reception signal. With this shape, a current path from the feeder portion electrode 20, which is an unbalanced line, to the radiation portion electrode 40, which is a balanced line, is maintained and transmission and reception signals are transferred. The radiation portion electrode 40 has two linear electrodes, having a predetermined length, extending in a direction vertical to the extending direction of the feeder portion electrode 20. The electrodes thereof are connected to the two electrodes of the balun electrode 30, respectively. This structure allows the radiation portion electrode 40 to function as a radiation portion of a dipole antenna. The waveguide portion electrode 50 is separated from the radiation portion electrode 40 by a predetermined interval and in parallel to the radiation portion electrode 40. The ground electrode 60 is formed on the back surface 112 corresponding to an area including the feeder portion electrode 20 and the balun electrode 30.

In addition, an array antenna of Non-Patent Document 1 includes antenna devices 100A-100D, each having the feeder portion electrode 20, the balun electrode 30, the radiation portion electrode 40, the waveguide portion electrode 50, and the ground electrode 60, arranged on the dielectric substrate 101 at a predetermined interval. The feeder portion electrodes of the antenna devices 100A and 100B are connected to a branch circuit 71, whereas the feeder portion electrodes of the antenna devices 100C and 100D are connected to a branch circuit 72. The branch circuits 71 and 72 are connected to a branch circuit 73. This structure allows a transmission wave signal fed to the branch circuit 73 to be diverged by the branch circuit 73 into the branch circuits 71 and 72, to be diverged by the branch circuit 71 into the antenna devices 100A and 100B, and to be diverged by the branch circuit 72 into the antenna devices 100C and 100D. On the other hand, a reflected wave signal received by the antenna devices 100A and 100B is transferred to a processing unit at a subsequent stage through the branch circuits 71 and 73. A reflected wave signal received by the antenna devices 100C and 100D is transferred to the processing unit at the subsequent stage through the branch circuits 72 and 73.

Non-Patent Document 1: William R. Deal, Noritake Kaneda, James Sor, Yongxi Qian, and Tatsuo Itoh, "A New Quasi-Yagi Antenna for Planar Active Antenna Arrays", JUNE 2000, IEEE TRANSACTIONS ON MICROWAVE THEORY AND TECHNIQUES, VOL. 48, NO. 6.

Nevertheless, since a feeder portion and a balun portion are separately formed in an antenna device shown in FIGS. 12(A) and (B) and the balun portion includes two U-shaped electrodes spreading in a direction vertical to an extending direction of the feeder portion, the antenna device requires a certain size of space although the antenna device has already been miniaturized. In addition, when an array antenna is formed using these antenna devices as shown in FIG. 12(C), a relatively large space is needed for each antenna device. Accordingly, when the number of antennas to be arranged is increased to sharpen the directivity of a reception beam for the purpose of an improvement in the detection accuracy, the space for the feeding portion and the balun portion relative to the entire space of the array antenna increases. Thus, decreasing the space is problematic when an array antenna using a plurality of these antenna devices, a multi-sector antenna having this array antenna, and a high-frequency wave transceiver are miniaturized. In addition, since the length of a transmission line connecting each unit becomes long, a transmission loss increases and an antenna gain decreases.

SUMMARY OF THE INVENTION

Accordingly, an object of the present invention is to provide a planar antenna device having a desired antenna gain and a shape smaller than conventional ones.

An antenna device of this invention includes a feeder electrode that is formed in a shape extending linearly on one surface of a dielectric substrate; a balanced electrode including one pair of electrodes that are connected to the feeder electrode, separated by an interval of an odd multiple of ½ of a wavelength of a transmission/reception signal, and formed in a shape extending in a direction crossing the extending direction of the feeder electrode at a predetermined angle; a radiation electrode of a predetermined length that is connected to each of the two electrodes of the balanced electrode and is formed in a shape extending in opposite directions along the extending direction of the feeder electrode; a waveguide electrode of a predetermined length that is located at a position separated from the radiation electrode by a predetermined length on a side of the radiation electrode opposite to the balanced electrode and is formed in a shape extending in parallel to the radiation electrode; and a ground electrode that is formed at an area of another surface facing an area of the one surface including at least a portion where the feeder electrode is formed but not including a portion where the radiation electrode and the waveguide electrode are formed.

In this configuration, upon being supplied through the feeder electrode, a transmission signal is diverged into two transmission path electrodes constituting the balanced electrode. Here, an interval between two junction points (branch points) of the feeder electrode and the balanced electrode is set to a length that is an odd multiple of ½ of a wavelength of a transmission/reception signal. More specifically, when "λ" represents the wavelength of the transmission/reception signal and N represents a natural number including "0", the interval is $((2N+1)\lambda/2)$. By means of this, phases of transmission signals transferred to the two transmission paths of the balanced electrode are shifted from one another by $\lambda/2$ and unbalanced-balanced transform is executed. If this balanced transmission signal is supplied to the radiation electrode, the radiation electrode functions as a dipole antenna and radiates a radio wave. Here, formation of the waveguide electrode allows the radio wave to be radiated from the radiation electrode while setting the side of the waveguide electrode as the center of the directivity according to the position and shape of this waveguide electrode. On the other hand, in the case of reception of a reflected wave, the reflected wave (reception signal) received by the radiation electrode is transferred to the two transmission paths of the balanced electrode. Since the interval between the junction points of the balanced electrode and the feeder electrode is set to a length of odd multiple of ½ of a wavelength of a transmission/reception signal, the reception signal is balanced-unbalanced transformed and is transferred to the feeder electrode.

In addition, the antenna device of this invention is characterized in that an interval with which the two electrodes of the balanced electrode are connected to the feeder electrode is a length of ½ of a wavelength of a transmission/reception signal.

In this configuration, by setting the interval between the junction portions (branch portions) of the two electrodes (transmission path electrodes) of the balanced electrode and the feeder electrode to the length that is ½ of a wavelength of the transmission/reception signal ($\lambda/2$), the unbalanced-balanced transform is performed with the shortest interval. By means of this, since the unbalanced-balanced transform is performed with the shortest interval, the transmission loss is suppressed to the minimum and the antenna device is miniaturized.

Additionally, the antenna device of this invention is characterized by further including: a reflecting member having a reflecting surface that is separated from the other surface at an area of the other surface corresponding to a position where the radiation electrode is formed and forms a predetermined angle with the other surface.

In this configuration, since part of transmission waves radiated from the radiation portion electrode is reflected by a reflecting surface that is separated from the dielectric substrate by a predetermined angle, the directivity corresponding to the shape of the reflecting surface is provided. Accordingly, by appropriately setting the reflecting surface, antenna devices each having the different center direction of the directivity can be realized. For example, if the tilt angle is changed, the center direction of the directivity can be changed along the direction vertical to the two surfaces of the dielectric substrate.

In addition, an array antenna of this invention is characterized in that a plurality of the above-described antenna devices are formed in the extending direction of the feeder electrode at a predetermined arrangement interval.

In this configuration, since the above-described antenna devices are connected to the feeder electrode in series and the branch portion has functions of a branch circuit and an unbalanced-balanced transformer unit in each antenna device as described above, the array antenna is formed with a structure in which an integrated unit of the branch circuit to the radiation antenna of each antenna device and the unbalanced-balanced transformer circuit is simply arranged along the feeder electrode.

Additionally, a multi-sector antenna of this invention is characterized in that the plurality of array antennas are formed using a single dielectric substrate so that transmission and reception directions differ.

In this configuration, since the plurality of array antennas having the above-described structure and a different transmission/reception direction are included, a multi-sector antenna capable of performing detection in a plurality of directions is formed.

In addition, a high-frequency wave transceiver of this invention is characterized by including: at least one of the above-described antenna devices, the array antenna, and the multi-sector antenna.

In this configuration, by including the above-described antenna devices, the array antenna, and the multi-sector antenna, a high-frequency wave transceiver according to a desired characteristic is formed.

According to this invention, since a branch from a feeder electrode and unbalanced-balanced transform can be realized with two electrode branches provided at an interval of an odd multiple of ½ of a wavelength of a transmission/reception signal, an antenna device smaller than a conventional antenna can be formed. In particular, by setting the electrode branch position to ½ of the wavelength, a further smaller antenna device can be formed. In addition, since the antenna device is in such a shape, the transmission loss is reduced and an antenna device having a superior antenna gain can be formed.

In addition, according to this invention, by including a reflecting surface that forms a predetermined angle with a dielectric substrate on a side of the dielectric substrate different from the radiation electrode side, the transmission/reception directivity can be appropriately set and an antenna device having a desired characteristic can be formed in a small size.

Additionally, according to this invention, by connecting the antenna devices in series with a feeder electrode, an array antenna can be formed with a structure in which an integrated unit of a branch circuit to a radiation electrode of each antenna device and an unbalanced-balanced transform circuit is simply arranged along the feeder electrode. This allows the array antenna to be formed in a small size.

In addition, according to this invention, by using a plurality of array antennas, a multi-sector antenna can be formed in a small size. Furthermore, using these antenna devices, array antenna, and multi-sector antenna, a high-frequency wave transceiver can be formed in a small size.

REFERENCE NUMERALS

Figure 1:
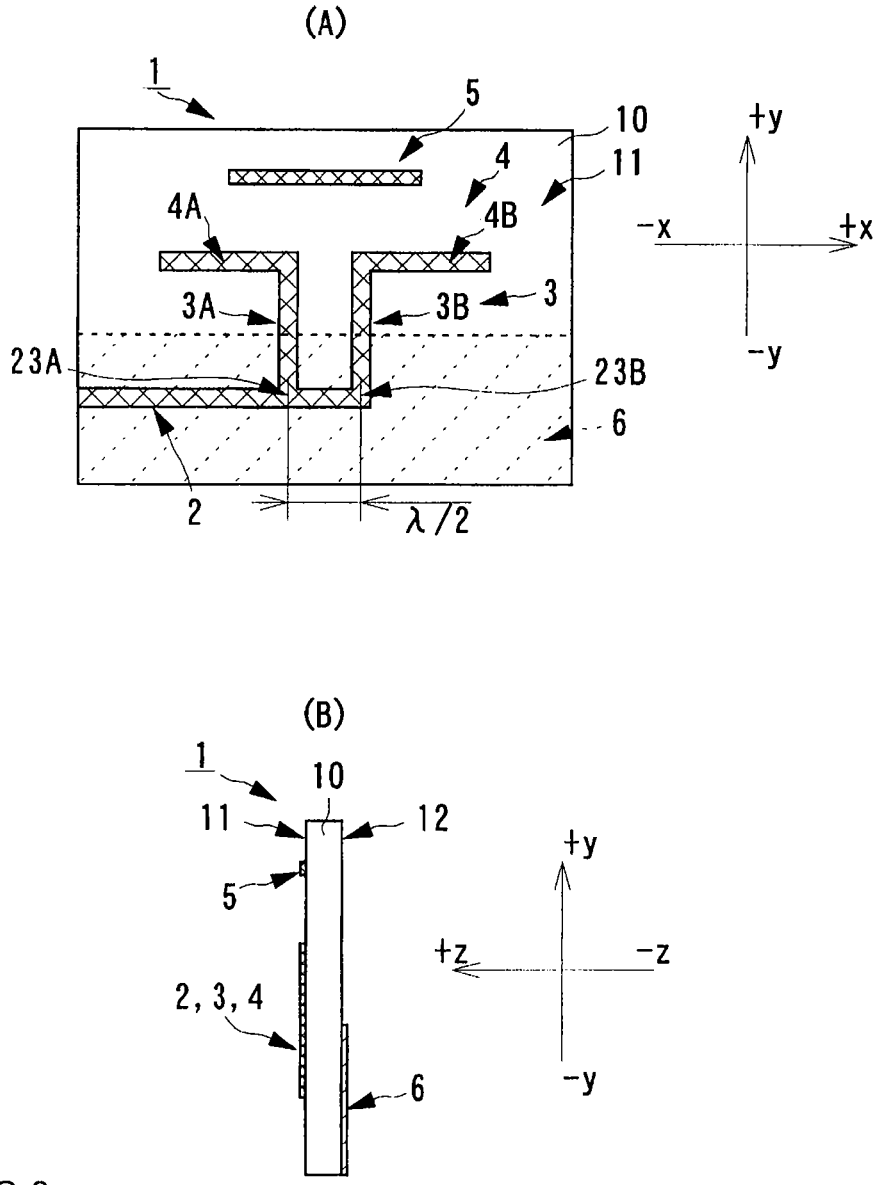
FIG. 1 are a plan view and a side view showing a structure of an antenna device 1 of a first embodiment.

1, 1', 1A-1H: antenna device, 2, 2A, 2B, 211, 212: feeder electrode, 3: balanced electrode, 3A, 3B: balanced transmission electrode, 23A, 23B: junction point, 4: radiation electrode, 4A: first electrode of radiation electrode 4, 4B: second electrode of radiation electrode 4, 5: waveguide electrode, 6: ground electrode, 7, 7A-7H: matching circuit, 8: corner cut portion, 9: reflector electrode, 10: dielectric substrate, 11: top surface of dielectric substrate 10, 12: back surface of dielectric substrate 10, 61: conductor plate, 62: planer portion, 63: curved portion, 63A: slope portion, 100, 100A-100D: antenna device, 101: dielectric substrate, 111: top surface, 112: back surface, 20: feeder electrode, 30: balun, 40: radiation electrode, 50: waveguide electrode, 60: ground electrode, 71-73: branch circuit, 200, 201, 202, 203: array antenna, 301: antenna unit, 302: signal processing unit, 303: VCO, 304: coupler, 305: circulator, 306: mixer, 307: LNA, 308: A/D converter

DETAILED DESCRIPTION OF THE INVENTION

An antenna device according to a first embodiment of the present invention will be described with reference to the drawings.

FIG. 1(A) is a plan view showing a structure of an antenna device 1 of this embodiment, whereas (B) is a side view thereof. In FIG. 1(A), the horizontal axis when viewed from the front is set as an x axis, whereas a direction toward the right and a direction toward the left are set as a +x direction and a −x direction, respectively. In addition, the vertical axis is set as a y axis, whereas an upward direction and a downward direction are set as a +y direction and a −y direction, respectively. In FIG. 1(B), the horizontal direction when viewed from the front is set as a z axis, whereas a direction toward the left and a direction toward the right are set as a +z direction and a −z direction, respectively. In addition, the vertical axis is set as a y axis, whereas an upward direction and a downward direction are set as a +y direction and a −y direction, respectively. Hereinafter, the description of a structure is given supplementary using these x axis, y axis, and z axis.

The antenna device 1 of this embodiment includes a dielectric substrate 10 having a predetermined expanse in directions of two axes (the x axis and the y axis) and a predetermined thickness in a direction of an axis (the z axis) vertical to these axes. A feeder electrode 2, a balanced electrode 3, a radiation electrode 4, and a waveguide electrode 5 are formed a top surface 11 (corresponding to "one surface" of the present invention), which is a surface of the dielectric substrate 10 in the +z direction. A ground electrode 6 is formed on a back surface 12 (corresponding to "another surface" of the present invention), which is a surface in the −z direction.

The feeder electrode 2 is a linear electrode that extends in the x-axis direction. Along the extending direction, the feeder electrode is connected to balanced transmission electrodes 3A and 3B of the balanced electrode 3 at an interval of ½ of a wavelength λ of a transmission/reception signal. In the description given below, a junction point of the feeder electrode 2 and the balanced transmission electrode 3A and a junction point of the feeder electrode 2 and the balanced transmission electrode 3B are referred to as a junction point 23A and a junction point 23B, respectively.

The balanced transmission electrodes 3A and 3B are connected to the feeder electrode at the junction points 23A and 23B vertically to the extending direction (the x axis) of the feeder electrode 2, respectively. The balanced transmission electrodes are formed in a shape extending in parallel to each other along this vertical direction (+y direction).

The radiation electrode 4 includes a first electrode 4A and a second electrode 4B to be connected to ends of the balanced transmission electrodes 3A and 3B opposite to the junction points 23A and 23B, respectively. These first electrode 4A and second electrode 4B are formed in a shape extending in parallel to the extending direction (the x axis) of the feeder electrode 2, namely, in a shape extending vertically to the extending direction (the y axis) of the balanced transmission electrodes 3A and 3B. At this time, the first electrode 4A extends in the −x direction from the junction point to the balanced transmission electrode 3A. The second electrode 4B is formed in a shape extending in the +x direction from the junction point to the balanced transmission electrode 3B. The length of the radiation electrode 4, which is constituted by the first electrode 4A, the second electrode 4B, and a gap between the first electrode 4A and the second electrode 4B, is set to a length that offers predetermined directivity as a dipole antenna.

The waveguide electrode 5 is formed in a shape extending in parallel to the extending direction (the x axis) of the radiation electrode 4. The waveguide electrode 5 is formed to be shorter than the length of the radiation electrode 4 at a position separated from the radiation electrode 4 by a predetermined distance on the side (+y direction) opposite to the balanced electrode 3 with respect to the radiation electrode 4. In addition, the center of the extending direction (the x axis) of the waveguide electrode 5 is arranged to substantially match the center of the extending direction (the x axis) of the radiation electrode 4 in the x-axis direction.

The ground electrode 6 is formed at an area of the back surface 12 corresponding to an area including a portion of the top surface 11 where the feeder electrode 2 is formed and a part of a portion where the balanced electrode 3 is formed but excluding portions where the radiation electrode 4 and the waveguide electrode 5 are formed. More specifically, the ground electrode 6 is formed at an area facing the feeder electrode 2 when the feeder-electrode-2-formed portion and the position of the balanced electrode 3 separated from the feeder electrode 2 by a predetermined distance but not reaching the radiation electrode 4 are employed as a boundary.

In such a configuration, the dielectric substrate 10, the feeder electrode 2, and the ground electrode 6 constitute a microstrip line. In addition, the dielectric substrate 10, a portion of the balanced electrode 3 near the feeder electrode 2, and the ground electrode 6 constitute a microstrip line. The dielectric substrate 10 and a portion of the balanced electrode 3 near the radiation electrode 4 constitute a coplanar guide.

By means of this, a transmission signal supplied from a transmission signal generating circuit (not shown) through the microstrip line including the feeder electrode 2 is diverged into the balanced transmission electrodes 3A and 3B of the balanced electrode 3 at the junction points 23A and 23B separated from one another by λ/2, respectively. Here, since the interval between the junction points 23A and 23B, namely, the interval of the transmission signal branch points, is λ/2, the transmission signal diverged into the balanced transmission electrode 3A and the transmission signal diverged into the balanced transmission electrode 3B have opposite phases. The balanced transmission signals are then transmitted by the microstrip lines having these balanced transmission electrodes 3A and 3B (the balanced electrode 3). That is, the unbalanced-balanced transform is performed.

The transmission line including the balanced transmission electrodes 3A and 3B is transformed from the microstrip line into the coplanar type and the balanced transmission signal is transmitted. The balanced transmission signal transferred through the transmission line having the balanced transmission electrodes 3A and 3B in this manner is supplied to the radiation electrode 4 and is radiated to a space from the radiation electrode 4 that functions as a dipole antenna. At this time, since the waveguide electrode 5 and the ground electrode 6 are arranged to face each other while sandwiching the radiation electrode 4 at the center along the direction (the y axis) vertical to the radiation electrode 4 and the waveguide electrode 5, this ground electrode 6 functions as a reflector, and a planar Yagi-Uda antenna including the radiation electrode 4, waveguide electrode 5, and ground electrode 6 is formed. With this, a transmission signal is radiated while the direction toward the waveguide electrode 5 from the radiation electrode 4 is set as the center of the directivity. Meanwhile, a reception signal having propagated through the space, received and following the path opposite to that of the transmission signal, is coupled at the two junction points of the balanced electrode 3 and the feeder electrode 2, is transferred to the microstrip line having the feeder electrode 2, and is output to a reception signal processing circuit (not shown) from this microstrip line.

As described above, the use of the structure of this embodiment allows a branch circuit (a coupled circuit) and an unbalanced-balanced transform circuit to be constituted only by the feeder electrode 2 and a transmission line having the balanced electrode 3 connected to the feeder electrode 2 at an interval of λ/2. This can simplify and miniaturize a structure of feeding a transmission signal from a feeder line, which is an unbalanced line, to a dipole antenna (planar Yagi-Uda antenna), which is a balanced antenna, and transferring a reception signal of the dipole antenna (planar Yagi-Uda antenna) to the feeder line. Furthermore, since the transmission line becomes shorter, a transmission loss is suppressed and an antenna gain is improved.

Meanwhile, although the interval between the junction points is set to λ/2 in the description given before, the interval between the junction points may be set to (2N+1)λ/2, where N is a natural number (including 0), which can provide similar effects and advantages.

In addition, the shape of each electrode constituting the above-described antenna device is one example and may be appropriately set according to a specification as shown next.

Figure 2:
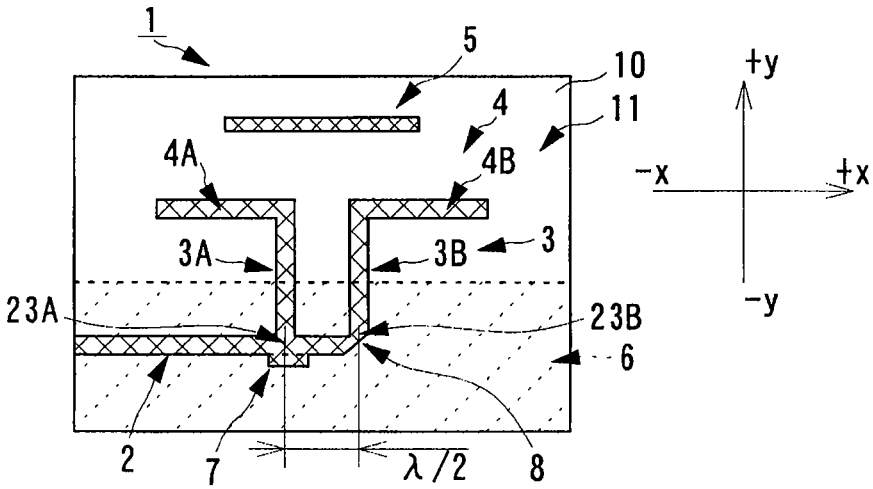
FIG. 2 is a plan view showing a structure of an antenna device including a matching circuit at a junction point of a feeder electrode and a balanced electrode.

FIG. 2 is a plan view showing a structure of an antenna device including a matching circuit at a junction point of a feeder electrode and a balanced electrode.

An antenna device 1 shown in FIG. 2 has a shape of which the width of the feeder electrode 2 is broadened by a predetermined length at a position of a junction point 23A of a feeder electrode 2 and a balanced transmission electrode 3A of a balanced electrode 3. In this case, the feeder electrode 2 is formed in a shape of which the width thereof spreads to the side (−y direction) opposite to the side of the balanced transmission electrode 3A. With this, a characteristic impedance of the line is adjusted and a matching circuit 7 of the side of the feeder electrode 2 and the side of the balanced transmission electrode 3A can be formed.

In addition, the antenna device 1 shown in FIG. 2 has a corner cut portion 8, whose corner is cut in a shape forming a predetermined angle with the extending direction of the feeder electrode 2 at a position of a junction point 23B of the feeder electrode 2 and a balanced transmission electrode 3B of the balanced electrode 3. By forming such a corner cut portion 8, the characteristic impedance of the lines on the side of the feeder electrode 2 and the side of the balanced transmission electrode 3B is adjusted.

Meanwhile, since other structures are the same as those of the antenna device 1 shown in FIG. 1, the description is omitted.

By appropriately setting the shapes of the matching circuit 7 and the corner cut portion 8 in this structure, the transmission loss of transmission/reception signals between the feeder electrode 2 and the balanced electrode 3 can be reduced. In addition, by appropriately setting the shapes of these electrodes, a signal branching ratio to the balanced transmission electrodes 3A and 3B can be set to a predetermined ratio. In this manner, an antenna device having desired directivity and a low loss can be formed.

Figure 3:
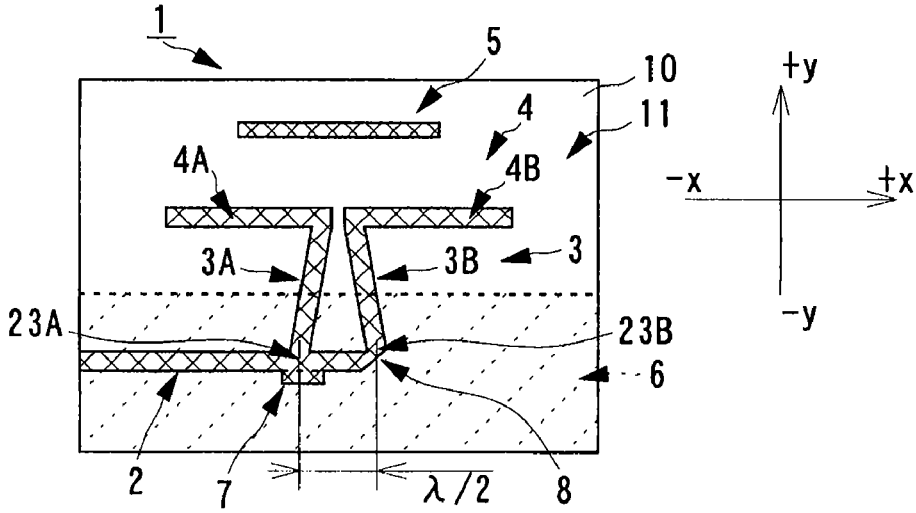
FIG. 3 is a plan view showing a structure of an antenna device having balanced transmission electrodes 3A and 3B of a balanced electrode 3 that are not parallel.

Next, FIG. 3 is a plan view showing a structure of an antenna device whose balanced transmission electrode 3A and 3B of a balanced electrode 3 are not in parallel.

In an antenna device 1 shown in FIG. 3, the balanced transmission electrodes 3A and 3B are formed so that an interval between the two balanced transmission electrodes 3A and 3B of the balanced electrode 3 gradually gets narrow toward the radiation electrode 4 from the feeder electrode 2. Other structures are the same as those of the antenna device shown in FIG. 2.

In such a configuration, since the interval between a first electrode 4A and a second electrode 4B of the radiation electrode 4 becomes shorter, the directivity different from that of the above-described antenna device having the shape that the balanced transmission electrodes 3A and 3B extend in parallel can be obtained. In addition, by appropriately setting this approaching ratio and a gap of the radiation electrode 4, a plurality of kinds of directivity can be obtained.

Figure 4:
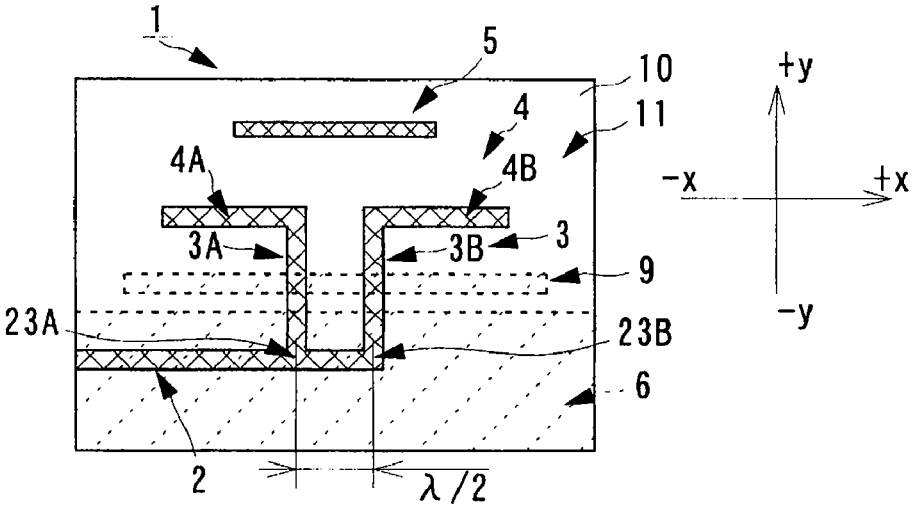
FIG. 4 is a plan view showing a structure of an antenna device including a reflector electrode 9.

Next, FIG. 4 is a plan view showing a structure of an antenna device including a reflector electrode 9.

In an antenna device 1 shown in FIG. 4, a reflector electrode 9 is formed on a back surface facing an area where a balanced electrode 3 is formed, in parallel to a radiation electrode 4 at a position separated from the ground electrode 6 by a predetermined distance in a direction (+y direction) toward the radiation electrode 4. This reflector electrode 9 is formed so that the center of the extending direction (the x direction) thereof substantially matches the center of the extending direction (the x axis) of the radiation electrode 4. In addition, the length along the extending direction (the x axis) of the reflector electrode 9 is set longer than that of the radiation electrode 4 by a predetermined amount. Meanwhile, other structures are the same as those of the antenna device shown in FIG. 1.

In such a configuration, since both the reflector electrode 9 and the ground electrode 6 function as a reflector of a Yagi-Uda antenna, a component of a transmission signal radiated from the radiation electrode 4 to the side of the feeder electrode 2 is suppressed and the transmission signal is more likely to be radiated in the direction of the waveguide electrode 4. With this, desired directivity is obtained, a reflection loss is reduced, and an effective antenna gain can be improved.

Meanwhile, although one reflector electrode 9 is provided in FIG. 4, a plurality of reflector electrodes may be provided in parallel.

Figure 5:
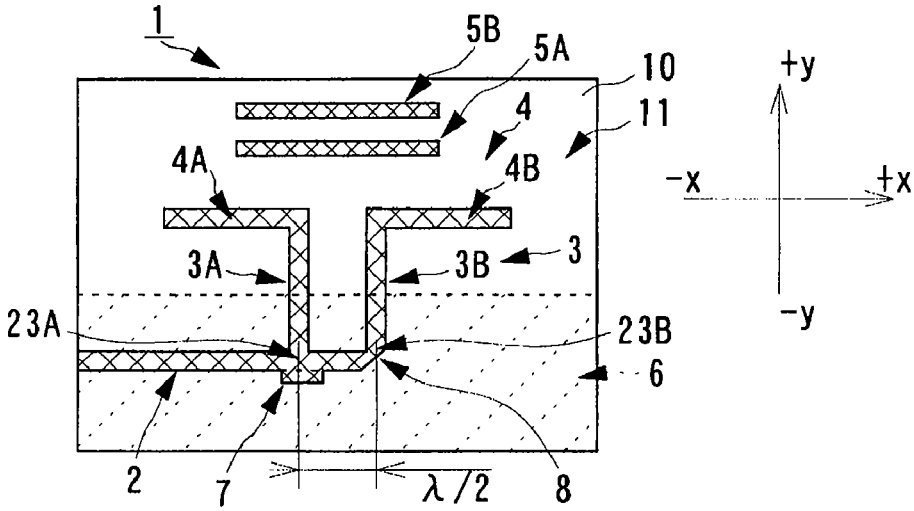
FIG. 5 is a plan view showing a structure of an antenna device including a plurality of waveguide electrodes.

Next, FIG. 5 is a plan view showing a structure of an antenna device having a plurality of waveguide electrodes.

In an antenna device 1 shown in FIG. 5, two waveguide electrodes 5A and 5B are formed at difference distances from a radiation electrode 4 on the side (the +y direction) of the radiation electrode 4 opposite to a feeder electrode 2. Each of the waveguide electrodes 5A and 5B is formed like a line extending in the same direction (the x-axis direction) as the radiation electrode 4. The radiation electrode 4 and the waveguide electrodes 5A and 5B are arranged in parallel. In addition, the waveguide electrodes 5A and 5B are formed in the same length and to be shorter than the radiation electrode 4 by a predetermined amount as in the case of the waveguide electrode 5 of FIG. 1. In addition, the center of the extending direction of the waveguide electrodes 5A and 5B is arranged to match the center of the extending direction of the radiation electrode 4. Meanwhile, other structures are the same as those of the antenna device shown in FIG. 2.

In such a configuration, since the directivity of a radiated transmission signal is narrowed by the two waveguide electrodes 5A and 5B, a narrower beam transmission signal can be radiated and, furthermore, an antenna gain can be improved.

Meanwhile, although two waveguide electrodes are provided in FIG. 5, three or more electrodes may be provided.

Figure 6:
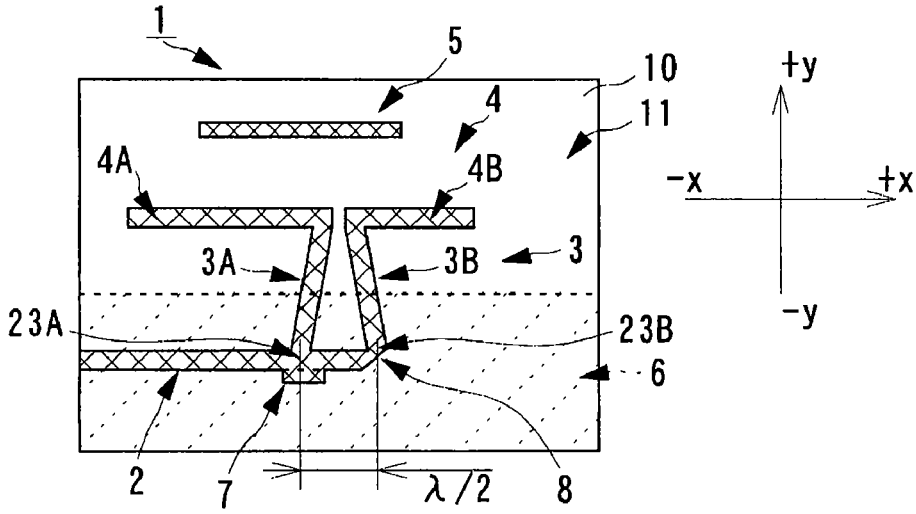
FIG. 6 is a plan view showing a structure of an antenna device in which lengths of a first electrode 4A and a second electrode 4B of a radiation electrode 4 differ.

Next, FIG. 6 is a plan view showing a structure of an antenna device having a first electrode 4A and a second electrode 4B of a radiation electrode 4 of different lengths.

In an antenna device 1 shown in FIG. 6, the length of the first electrode 4A of the radiation electrode 4 is longer than the length of the second electrode 4B. In addition, a waveguide electrode 5 is provided so that the center of the extending direction thereof matches the center of the extending direction of the radiation electrode 4. The centers of the extending directions of these waveguide electrode 5 and radiation electrode 4 are arranged at a position shifted from a position of a line symmetric axis of balanced transmission electrodes 3A and 3B of a balanced electrode 3. Here, although the length of the first electrode 4A and the length of the second electrode 4B are set differently, the length of the radiation electrode 4 is set to a length described above. Other structures are the same as those of the antenna device shown in FIG. 3.

In such a configuration, since the center direction of the directivity can be shifted, for example, along the x axis by the shape of the radiation electrode 4 and the position of the waveguide electrode 5, the directivity can be changed. This can realize various kinds of directivity, such as, for example, changing the beam direction and the beam width.

In addition, a plurality of the above-described structures of FIG. 2 to FIG. 6 may be combined instead of using these individually. For example, a structure including a matching circuit and a corner cut portion, including a reflector electrode different from a ground electrode, and further including a plurality of waveguide electrodes or the like may be used. By using such a combination, the antenna device of this embodiment can realize various kinds of directivity with a simple and small structure.

Next, an antenna device according to a second embodiment will be described with reference to the drawings.

FIG. 7(A) is an exterior perspective view of an antenna device 1' of this embodiment, whereas (B) is a side view thereof. In addition, FIG. 7(C) is a side view showing a different structure of an antenna device of this embodiment.

Figure 7:
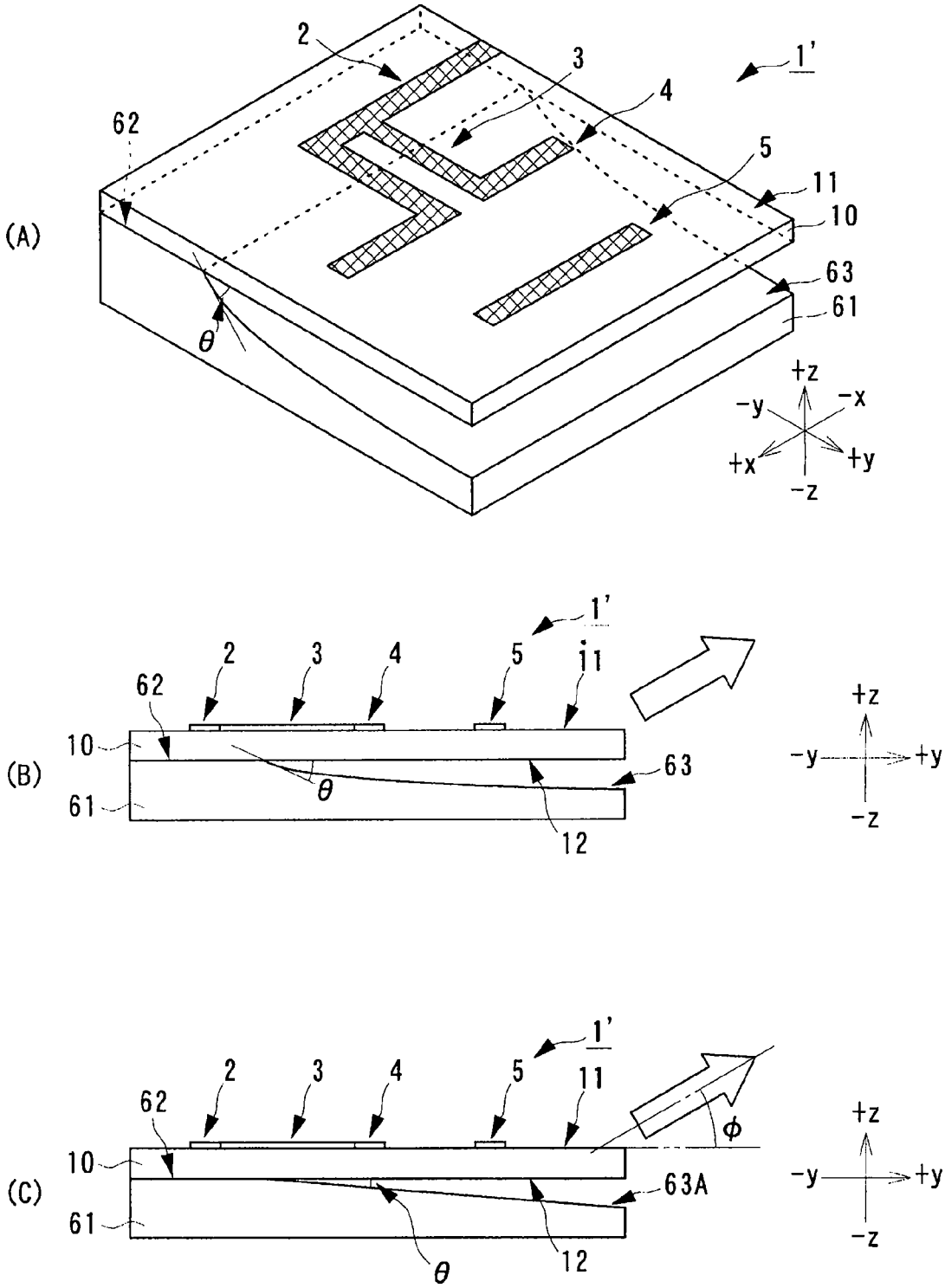
FIG. 7 are an external perspective view and a side view of an antenna device of a second embodiment, and a side view showing an antenna device of a different structure.

In contrast to the antenna device 1 shown in FIG. 1, a conductor plate 61 is provided on a back surface 12 of a dielectric substrate 10 instead of the ground electrode 6 in the antenna device 1' shown in FIG. 7. The structures on a top surface 11 of the dielectric substrate 10 are the same and the description regarding the top surface 11 is omitted.

The conductor plate 61 is formed in a shape substantially the size of the dielectric substrate 10 in a plan view of an x-y plane. A surface from one lateral face (a lateral face in the –y direction of FIG. 7) to a predetermined distance is formed like a plane (a planar portion 62). A surface from an end of this planar portion 62 to the other lateral face (a lateral face in the +y direction of FIG. 7) is formed like a curved surface (a curved portion 63). The curved portion 63 is a surface formed in a shape of which the thickness gradually decreases from the boundary with the planar portion 62 toward the other lateral face. The sectional shape along the thinning direction (the y-axis direction) is parabolic. In addition, the curved portion 63 makes contact with the back surface 12 of the dielectric substrate 10 at an angle θ at the boundary point with the planar portion 62 when viewed from the x-axis direction.

The planar portion 62 of the conductor plate 61 abuts against the back surface 12 of the dielectric substrate 10. The size of the abutted area is substantially equal to that of the ground electrode 6 shown in FIG. 1. This allows the conductor plate 61 to function as a reflector for the y-axis direction as in the case of the ground electrode 6 shown in FIG. 1. In addition, since the curved portion 63 is not parallel to the electrode surfaces of the radiation electrode 4 and the waveguide electrode 5, transmission signals are reflected at different angles at respective positions. Accordingly, the radiation direction of the transmission signal can be set to a direction (the +y and +z directions of the y-z plane) forming a predetermined angle with the lateral face direction of the top surface 11 according to an angle between the curved surface 63 and the radiation electrode 4 or the waveguide electrode 5. By means of this, transmission/reception can be performed in a direction forming a predetermined angle with the top surface of the antenna device 1'.

Figure 8:
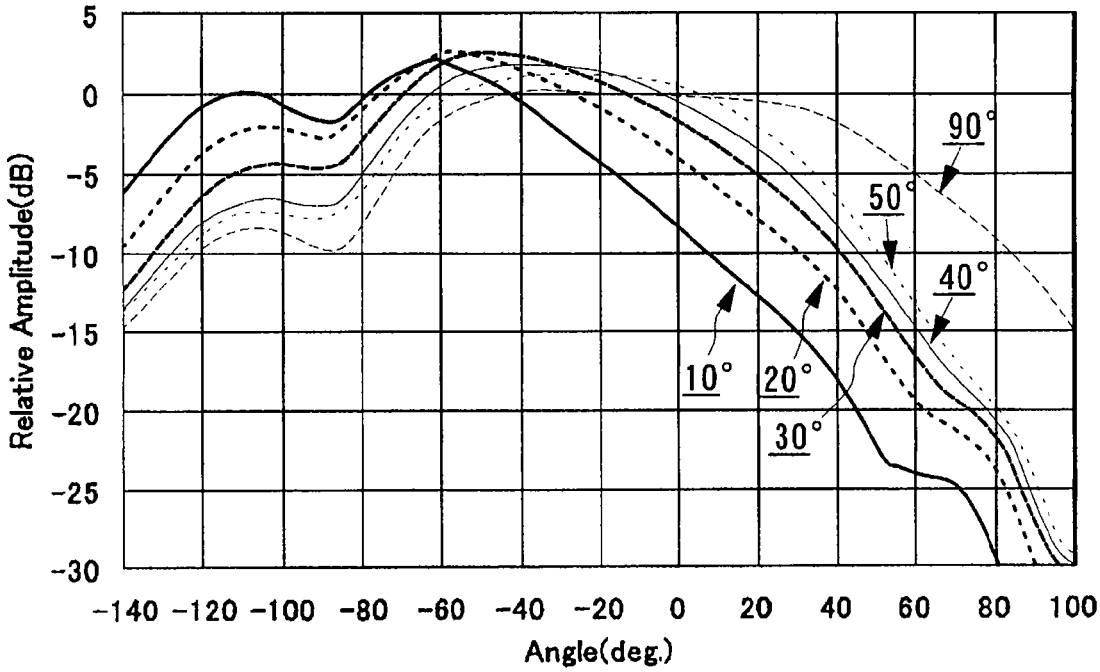
FIG. 8 are results of a simulation using a conductor plate 61 having a slope portion 63A.
Figure 8:
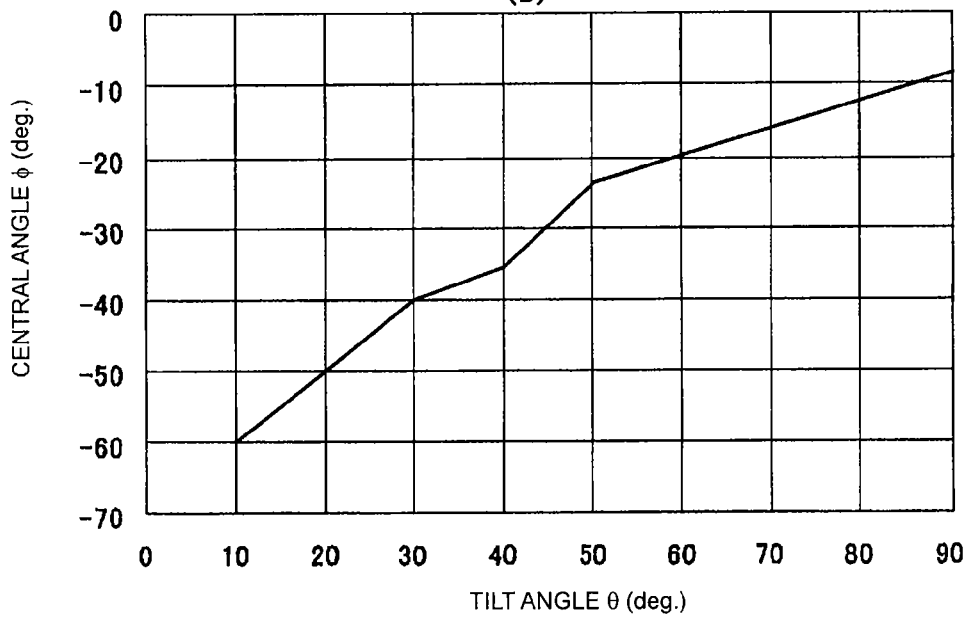

Results of a simulation using a slope portion 63A that is not curved but planar and forms a predetermined angle θ with the planar portion 61 as shown in FIG. 7(C) as the antenna device 1' having such a structure are shown in FIGS. 8(A) and (B).

FIGS. 8(A) and (B) show results of a simulation using the conductor plate 61 including the slope portion 63A. FIG. 8(A) shows antenna directivity, whereas FIG. 8(B) shows a change in a center direction angle $\phi$ of a transmission/reception signal with respect to a tilt angle $\theta$. In this drawing, the center direction angle of the transmission/reception signal indicates an angle $\phi$ of the center direction of the directivity of the transmission/reception signal with respect to the top surface 11 and the angle $\phi$ decreases (−value increases) as the conductor plate approaches the top surface 11 in the +z direction.

As shown in FIGS. 8(A) and 8(B), the angle $\phi$ between the center direction of the directivity of the transmission/reception signal and the top surface 11 increases as the tilt angle $\theta$ decreases. By appropriately setting the tilt angle $\theta$ using this, the center direction of the transmission/reception signal can be variably set along the z-axis.

In addition, by combining the structures of the antenna devices shown in FIG. 2 to FIG. 6 and the structure of the antenna shown in FIG. 7, the center direction of the directivity can be set along each of two planes, which are the x-y plane and the z-y plane, for example, in FIG. 7. Accordingly, an antenna device that three-dimensionally sets the center direction of the directivity of a transmission/reception signal can be formed with a simple and small structure.

Next, an array antenna according to a third embodiment will be described with reference to the drawing.

Figure 9:
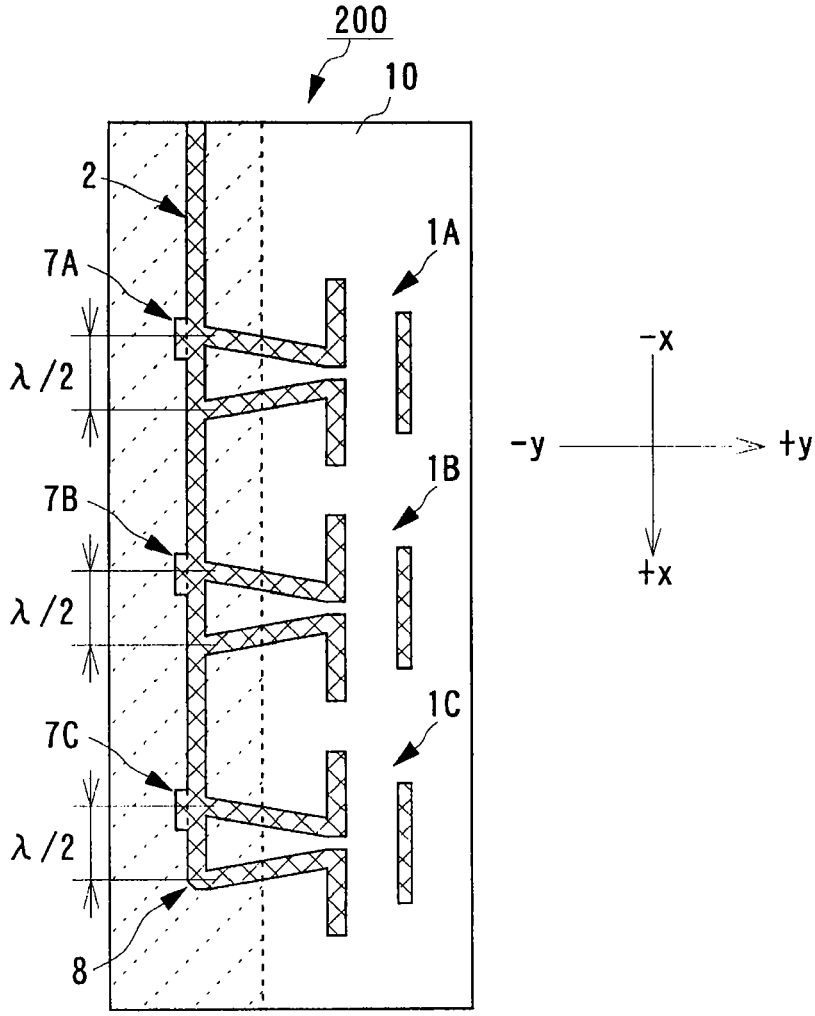
FIG. 9 is a plan view showing a structure of an array antenna of a third embodiment.

FIG. 9 is a plan view showing a structure of an array antenna 200 of this embodiment.

As shown in FIG. 9, the array antenna 200 has a feeder electrode 2 extending linearly on the top surface of a dielectric substrate 10 in the x-axis direction. In addition, the array antenna 200 includes a balanced electrode, a radiation electrode, and a waveguide electrode for each of antenna devices 1A to 1C on the top surface of the dielectric substrate 10. Each of the antenna devices 1A to 1C is formed in the same shape as the above-described antenna device 1 shown in FIG. 3 except for the corner cut portion. In addition, in the array antenna 200, a junction position of the feeder electrode 2 and the balanced electrode of each of the antenna devices 1A to 1C is in a structure similar to the matching circuit 7 and the corner cut portion 8 shown in FIG. 3. Matching circuits 7A to 7C and a corner cut portion 8, each set with a predetermined matching condition, are formed.

Intervals between respective antenna devices 1A to 1C are set to a length of one wavelength of a transmission/reception signal. Meanwhile, it is desirable to set the interval between the antenna devices to 0.8$\lambda$ to 0.9$\lambda$, where $\lambda$ represents the wavelength, in consideration of a side lobe generated by each antenna device. However, the interval is not limited particularly to this range and may be set to be substantially equal to $(n+\frac{1}{2})\lambda$, where n is a natural number.

In addition, in each of the antenna devices 1A to 1C, the respective balanced electrode, radiation electrode, and waveguide electrode are provided in the same direction (the +y direction) with respect to the feeder electrode 2. Such a configuration allows a transmission/reception beam of a transmission/reception signal whose center direction points the +y direction to be realized with the antenna devices 1A to 1C.

In the configuration of this embodiment, a balun for each antenna device and branch circuits that connect each antenna device in a tree structure do not have to be formed through a respective transmission line as in the case of a conventional example shown in Non-Patent Document 1. Thus, a planar array antenna can be formed with a simple and small structure. Furthermore, since the transmission distance to the radiation electrode becomes shorter, a planar array antenna having a low loss can be formed.

In addition, by using the structures shown in FIG. 2 to FIG. 7 as the shape of each antenna device and appropriately setting the interval between the antenna devices in such a configuration, a small array antenna capable of realizing desired directivity can be formed.

Next, a multi-sector antenna according to a fourth embodiment will be described with reference to the drawing.

Figure 10:
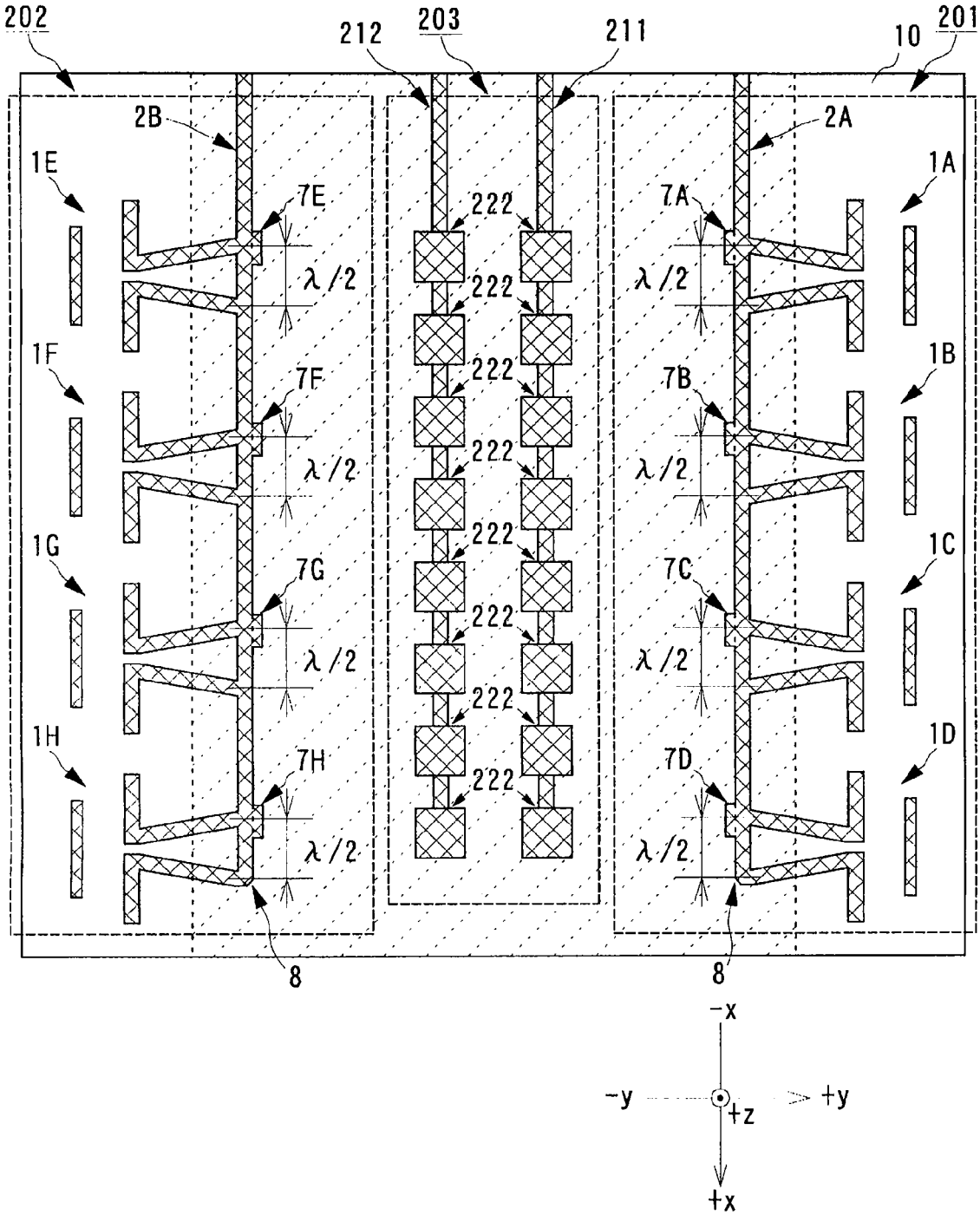
FIG. 10 is an elevational view showing a structure of a multi-sector antenna of a fourth embodiment.

FIG. 10 is an elevational view showing a structure of a multi-sector antenna of this embodiment.

As shown in FIG. 10, four feeder electrodes 2A, 2B, 211, and 212 are formed on a top surface of a dielectric substrate 10 in a shape extending along the x-axis direction. Array antennas 201 and 202 have a structure similar to that of the array antenna 200 shown in FIG. 9 and each of them are constituted by four antenna devices. The array antenna 201 has a structure that connects the antenna devices 1A to 1D to a microstrip line including the feeder electrode 2A while performing the matching with matching circuits 7A to 7D and has the center direction of the directivity in the +y direction. The array antenna 202 has a structure that connects antenna devices 1E to 1H to a microstrip line including the feeder electrode 2B while performing the matching with matching circuits 7E to 7H and has the center direction of the directivity in the −y direction.

The array antenna 203 is constituted by eight patch electrodes 222 formed at a predetermined interval along the feeder electrodes 211 and 212. With this structure, the array antenna 203 has the center direction of the directivity in the +z direction substantially vertical to a top surface of the dielectric substrate 10.

Here, the array antennas 201 and 202 are formed in a shape that is parallel to the feeder electrodes 2A and 2B and line symmetric with respect to an axis (a symmetry axis) located at the middle of the feeder electrodes 2A and 2B. In addition, the array antenna 203 is arranged at a position where the patch electrode 222 provided at the feeder electrode 211 and the patch electrode 222 provided at the feeder electrode 212 become symmetrical with respect to the symmetry axis. Meanwhile, such symmetry is not absolute and may be appropriately set according to the required antenna characteristic.

With such a configuration, a multi-sector antenna having directivity of the front direction with the array antenna 203 and directivity in lateral directions with the array antennas 201 and 202 can be formed. In this multi-sector antenna, a simple and small structure can be realized using the structures of the above-described antenna device and array antenna. In addition, since the transmission distance to each radiation electrode becomes shorter in the array antenna for the lateral direction detection, a multi-sector antenna having a low loss can be formed. Furthermore, by employing structures of the antenna devices shown in FIG. 2 to FIG. 6 and FIG. 7 in the multi-sector antenna, various kinds of antenna directivity can be realized in a small size.

Next, a radar apparatus according to a fifth embodiment will be described with reference to the drawing.

Figure 11:
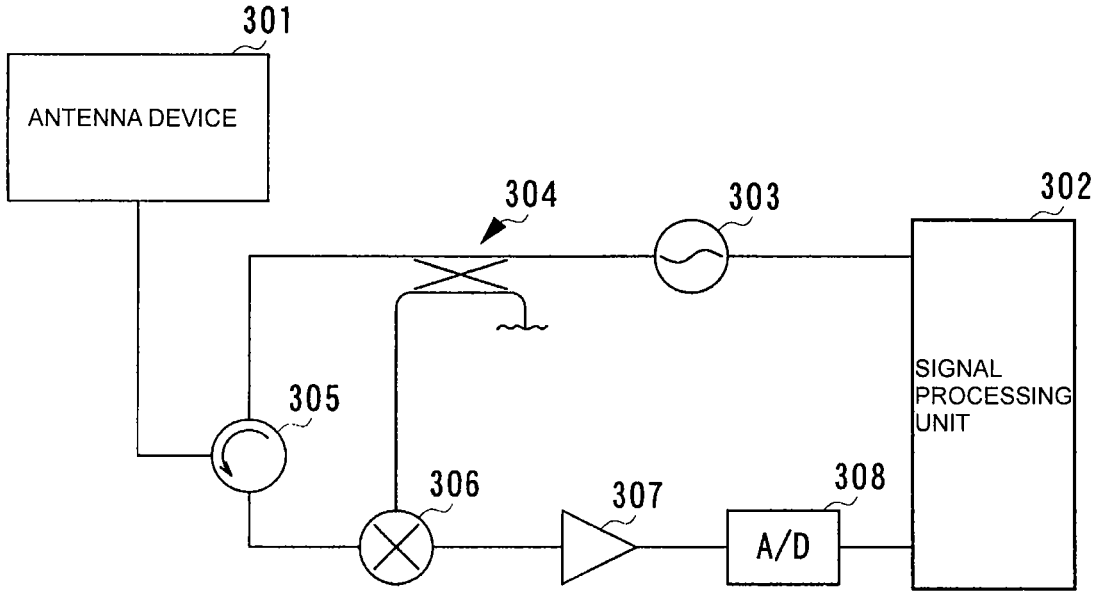
FIG. 11 is a block diagram showing a configuration of major units of a radar apparatus of a fifth embodiment.
Figure 12:
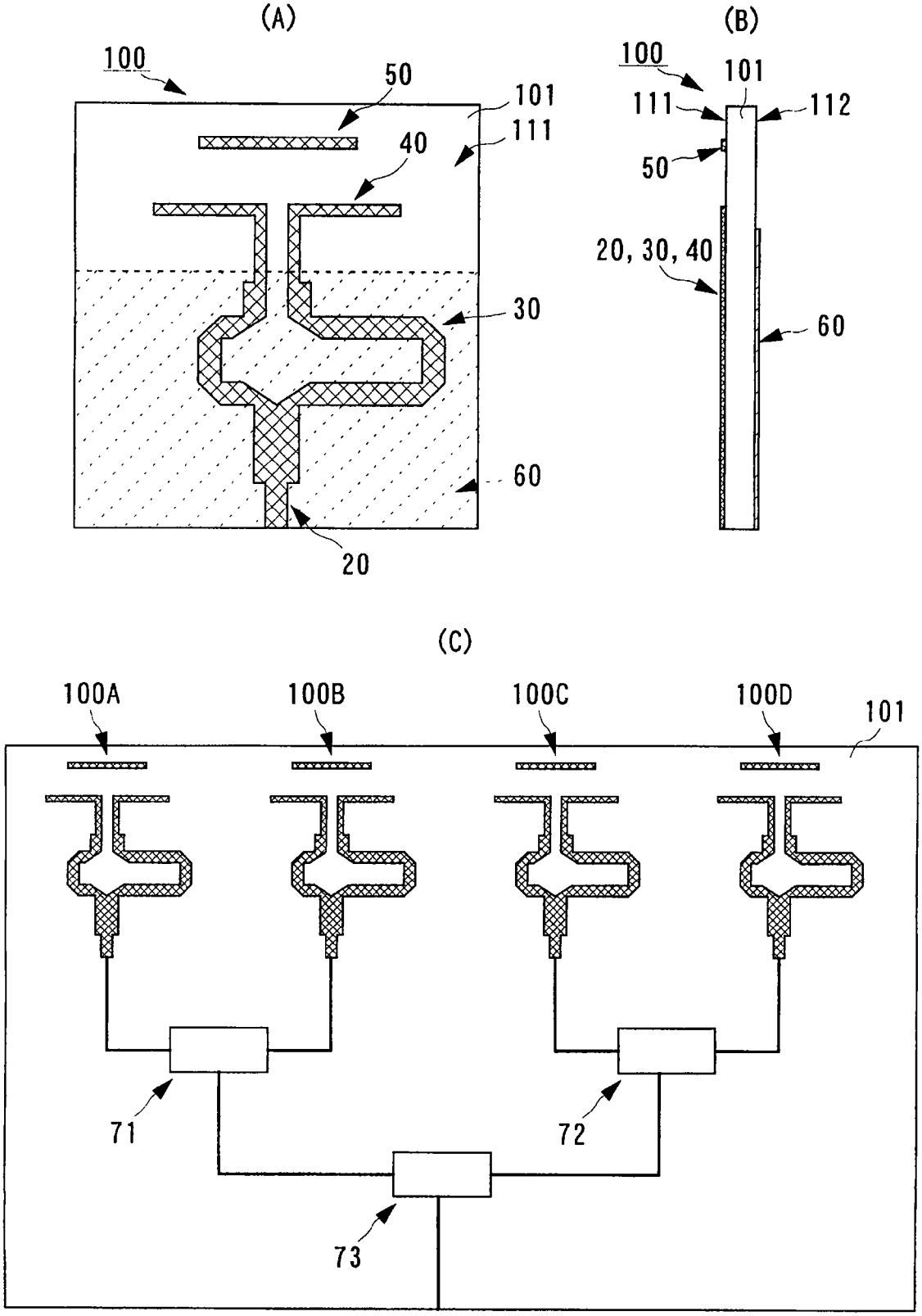
FIG. 12 are configuration diagrams of an antenna disclosed in Non-Patent Document 1 and a configuration diagram of an array antenna having a plurality of these antenna devices arranged therein.

FIG. 11 is a block diagram showing major configurations of a radar apparatus of this embodiment.

A signal processing unit 302 generates a control voltage for forming a transmission beam on the basis of FMCW detection processing and supplies the voltage to a VCO 303. The VCO 303 generates a transmission signal whose frequency is continuously modulated in a triangular shape in a time series according to the supplied control voltage. A coupler 304 outputs the input transmission signal to a circulator 305 and also supplies part thereof to a mixer 306 as a local signal. The circulator 305 outputs the transmission signal fed from the coupler 304 to an antenna unit 301.

The antenna unit 301 includes the array antenna shown in FIG. 9 or the multi-sector antenna shown in FIG. 10. Each antenna of the array antenna and the multi-sector antenna are constituted by the antennas shown in FIG. 1 to FIG. 7.

The circulator outputs a reception signal fed from the antenna unit 301 to the mixer 306. The mixer 306 mixes the local signal fed from the coupler 304 and the reception signal fed from the circulator 305, thereby generating a beat signal. The mixer then outputs the beat signal to an LNA 307. The LNA 307 amplifies the beat signal and supplies the beat signal to an A/D converter 308. The A/D converter 308 performs A/D conversion on the amplified beat signal and supplies the signal to the signal processing unit 302. The signal processing unit 302 calculates a relative speed and a relative distance of a target using a known FMCW data processing method on the basis of the digitalized beat signal.

With such a configuration, since the antenna unit 301 is miniaturized, the radar apparatus can be miniaturized. In addition, since the loss of the antenna unit 301 decreases, a radar apparatus having a low antenna loss can be formed and a detection ability can be improved.

Meanwhile, although an FMCW radar apparatus is described in this embodiment, radar apparatuses according to other methods may employ the planar antenna, the array antenna using these planar antennas, or the multi-sector antenna.

The invention claimed is:

1. An antenna device comprising:

A dielectric substrate having a first surface and a second surface opposite the first surface;

a feeder electrode extending linearly in a first direction on the first surface of the dielectric substrate;

a balanced electrode connected to the feeder electrode and extending in a second direction that crosses the first direction at a predetermined angle, the balanced electrode including a pair of electrodes separated by an interval of an odd multiple of ½ of a wavelength of a transmission/reception signal;

a respective radiation electrode connected to each electrode of the pair of electrodes of the balanced electrode, the respective radiation electrodes extending in opposite directions to each other along the first direction;

a waveguide electrode located at a position separated from the radiation electrodes and on a side of the radiation electrodes opposite to the balanced electrode, the waveguide electrode extending substantially in parallel to the radiation electrode.

2. The antenna device according to claim 1, wherein an interval at which the two electrodes of the balanced electrode are connected to the feeder electrode is ½ of a wavelength of a transmission/reception signal.

3. The antenna device according to claim 1, further comprising a ground electrode on the second surface of the dielectric substrate, the ground electrode being located on the second surface so as to face an area of the first surface that includes at least a portion where the feeder electrode is located but does not include a portion where the radiation electrode and the waveguide electrode are located.

4. The antenna device according to claim 3, further comprising at least one reflector electrode on the second surface of the dielectric substrate.

5. The antenna device according to claim 4, wherein the at least one reflector electrode is positioned on the second surface of the dielectric substrate so as to face the balanced electrode and be in parallel to the radiation electrode.

6. The antenna device according to claim 1, further comprising:

a reflecting member positioned adjacent the second surface of the dielectric substrate, the reflecting member having a reflecting surface that is separated from the second surface at an area corresponding to a position of the radiation electrode, the reflecting surface forming a predetermined angle with respect to the second surface.

7. The antenna device according to claim 6, wherein the reflecting surface is curved.

8. The antenna device according to claim 1, wherein a length of the waveguide electrode is shorter than a length of the respective radiation electrodes.

9. The antenna device according to claim 1, further comprising a matching circuit positioned at a junction between the feeder electrode and the balanced electrode.

10. The antenna device according to claim 1, wherein the feeder electrode and the balanced electrode define a predetermined angle at a junction thereof.

11. The antenna device according to claim 1, wherein the pair of electrodes of the balanced electrodes are not parallel to each other.

12. The antenna device according to claim 1, wherein the waveguide electrode is a first waveguide electrode, the antenna device further comprising a second waveguide electrode separated from the radiation electrodes by a different distance than the first waveguide electrode.

13. The antenna device according to claim 1, wherein the respective radiation electrodes have different lengths.

14. An array antenna comprising:

a plurality of antenna devices according to claim 1 formed in the first direction at a predetermined arrangement interval.

15. The array antenna according to claim 14, wherein the predetermined arrangement interval is one wavelength of the transmission/reception signal.

16. The array antenna according to claim 14, wherein the predetermined arrangement interval is $0.8\lambda$ to $0.9\lambda$, where $\lambda$ represents the wavelength of the transmission/reception signal.

17. The array antenna according to claim 14, wherein the predetermined arrangement interval is substantially equal to $(n+\frac{1}{2})\lambda$, where n is a natural number and $\lambda$ represents the wavelength of the transmission/reception signal.

18. A multi-sector antenna comprising:

a plurality of array antennas according to claim 14 formed on a single dielectric substrate, and positioned so that transmission and reception directions differ between at least two of the plurality of array antennas.

19. A high-frequency wave transceiver comprising: at least one antenna device according to claim 1.

* * * * *